United States Patent [19]

Tinnes

[11] 4,076,153

[45] Feb. 28, 1978

[54] PLATE STRUCTURE FOR A LIQUID METAL CONTAINER CLOSURE

[75] Inventor: Bernhard Tinnes, Zollikerberg, Switzerland

[73] Assignee: Metacon AG, Zurich, Switzerland

[21] Appl. No.: 620,270

[22] Filed: Oct. 7, 1975

[30] Foreign Application Priority Data

Oct. 24, 1974 Sweden ..... 7414231

[51] Int. Cl.[2] ..... B22D 41/08

[52] U.S. Cl. ..... 222/600; 222/512

[58] Field of Search ..... 222/512, 561, DIG. 7, 222/600; 164/337

[56] References Cited

U.S. PATENT DOCUMENTS

| | | | |
|---|---|---|---|
| 3,436,023 | 4/1969 | Thalmann | 222/600 X |
| 3,567,082 | 3/1971 | Tinnes | 222/561 |
| 3,779,431 | 12/1973 | Tinnes et al. | 222/561 |
| 3,850,351 | 11/1974 | Yoshihara | 222/561 UX |
| 3,887,117 | 6/1975 | Fehling | 222/561 X |
| 3,912,135 | 10/1975 | Meier | 222/600 |

OTHER PUBLICATIONS

Tanaka; *Iron and Steel Engineer;* Sept. 1973: pp. 117–124.

*Primary Examiner*—Robert B. Reeves
*Assistant Examiner*—David A. Scherbel
*Attorney, Agent, or Firm*—Cushman, Darby & Cushman

[57] ABSTRACT

The disclosure embraces a structure for plates provided on a sliding closure of an outlet or spout of a container for liquid metal, one side of each plate serving as a sealing surface which cooperates with the other, relatively movable plate of the closure; the plates have a passage running approximately perpendicularly relative to the sealing surface or surfaces with the other sides of the plate facing away from the sealing surfaces having annular grooves or keys for cooperating with complimentary shaped portions of either an outlet casing or a stone casing of the container.

5 Claims, 2 Drawing Figures

PLATE STRUCTURE FOR A LIQUID METAL CONTAINER CLOSURE

BACKGROUND AND SUMMARY OF THE INVENTION

In the field of handling of molten metals, the problem of discharging the molten metals from crucibles or similar containers has necessitated the use of very expensive materials for forming such valved outlets so that the outlets can safely be used and withstand the extremely high temperatures that result from the materials being handled and passed through the outlet. In general, the outlets have been subject to leakages due to rapid expansion upon exposure to the molten liquids and then rapid contraction when the valve closure is shut or the container emptied. It has previously been known to employ a bottom plate which surrounds the outlet channel of the vessel or crucible and a similarly shaped valve plate which is movable relative to the bottom plate so that these plates can be interchangeable thus reducing the costs of replacing one or the other plates when such plates become worn or cracked due to use over a period of time.

Such interchangeable plates are provided with apertures through which the molten metal passes when the apertures are aligned by moving one plate, the valve plate, relative to the bottom plate of the vessel. It has been the practice to provide on such a plate a key of some form, for example, a projection which would cooperate with a groove on another part of the assembly such as the perforated stone casing or the discharge casing. It has been the accepted practice to provide the projection or key so that it extends in the direction of flow of the molten liquid metal. However, with interchangeable plates, where the key is provided on the casing, then the key must run in a groove formed on the valve plate so that, at least with the valve plate, the key portion will extend counter to the direction of flow which is undesirable. Of course, whenever on the other hand, the key has been provided on the plates, then the key will extend in the wrong direction, that is, counter to the direction of liquid flow, at least on the side of the bottom plate of the vessel which faces away from the identically shaped valve plate.

With these previously employed embodiments, whenever a deviation from the accepted practice as mentioned above must be employed, it has been preferred to use the arrangement where the key surface or projection has been provided on the casing for the reason that the accepted practice would be followed in a critical area of the sliding closure,namely, at the groove and key connection lying above the sealing surface of the plates. This is important since the highest liquid pressure occurring in the sliding valve closure exists at the sealing surfaces for every position of the valve. In addition to the departure from the accepted practice with regard to the groove and key connection lying below the sealing plane, this embodiment has two other severe disadvantages. Firstly, the plate or plates are considerably weakened as a result of the indentation which provides the groove at a critical point of the plate, namely, immediately around the aperture defining a portion of the flow passage, and, secondly, the expansion or butt joints of the groove and key connections on both sides of the sealing surface will be disposed where the flow turbulence is always the greatest in a circumstance where the valve plate is not completely open.

In another known embodiment, where the key surface is provided on the surface of the plate, there will be, of course, no weakening of the structural integrity of the plate and, in addition, the joints of the groove and key connection are also located away from the area of greatest flow turbulence. However, a serious drawback still exists due to the fact that the greatest thickness which consists of the thickness of the plate plus the height of the key which projects from the plate and the area where the greatest temperature elevation is experienced on the plate coincide. It is well known, of course, that the absolute measure of the degree of expansion results from a consideration of the dimension of the element and the temperature of the element at the place being observed. Assuming the usual case where a sufficient pretension or strengthening as by hardening of the sealing surfaces is provided, the expansion of the thickness of the plates can occur only in a direction which extends away from the sealing surfaces. Extensive experiments have been conducted and the results reported concerning the fact that such expansions, due to the fact that they cannot be freely absorbed in the system of these elements, result in considerable pressure loads on the edges defined by the passage and by the sealing surfaces. As a result, where relative movement of the plates takes place, cracking or breaking of the plates occurs. Moreover, there is the danger that the plate will be broken at the point the key projection is connected to the plate due to internal stresses that exist.

Of course, when the pretensioning forces of the sealing surfaces is less than the force created by the heat expansion in the area of the flow passage, the plates will be able to easily expand in the direction extending toward the sealing surfaces but, in so doing, a critically undesirable formation of a gap between the sealing surfaces of the bottom plate and valve plate will result in the areas of the plate remote from the sealing surfaces. The portions of the plates that are thus exposed as a result of the formations of the gap can easily break away resulting in a dangerous outflow of the liquid metal through any gaps that develop.

It is an object of the present invention to avoid the foregoing difficulties by providing interchangeable plates with an improved groove and key connection which can still be used to cooperate with the adjacent casings of the vessel and discharge outlet.

More specifically, the present invention provides means for the formation of a groove and key connection in the form of a bead projecting from the side of the plate which faces away from the sealing surface of the plate with the bead having two flanks which are in the form of annular surfaces concentric about themselves, the straight generatrices of which surfaces run at a slant in opposite directions relative to the axis of the flow passage and the base of the bead and the inside flank of the bead lies on a diameter which is greater than the diameter of the passage.

With the structure of the present invention, it will be possible to dimension the thickness of the plate immediately adjacent the passage independently of the dimensioning practices relating to the formation of a groove and key connection so that, as a result, the usual condition, on the one hand, relating to the expansion of the elements and, on the other hand, relating to the distance of the butt joints from the sealing surfaces of the plate will be optimally satisfied. Moreover, the two flanks of the bead forming the key are situated and shaped so that it will be possible to use the plate either as a part forming a groove or a key so that the plate can perform both of these functions simultaneously.

Further, by the use of the present invention, it will be possible, perhaps without deviating from the accepted practice relating to the orientation of the groove with reference to the direction of flow of the liquid metal, to operate with plates of the same shape and dimensions so that the plates can be interchangeably employed. Also, advantageously, the bead will be disposed in an area of lesser temperature differences as a result of its being disposed at a distance from the flow passage thus minimizing or entirely eliminating the danger of cracks due to tension. It will also be noted that the disposition of the bead away from the flow passage will still impart a desired reinforcement to the plates to prevent or at least minimize bending in the area where the plate is supported to a lesser degree by the surrounding housing structure.

The foregoing and other advantages will become apparent as further consideration is given to the following detailed description together with the accompanying drawings.

DETAILED DESCRIPTION OF THE INVENTION

Figure 1:
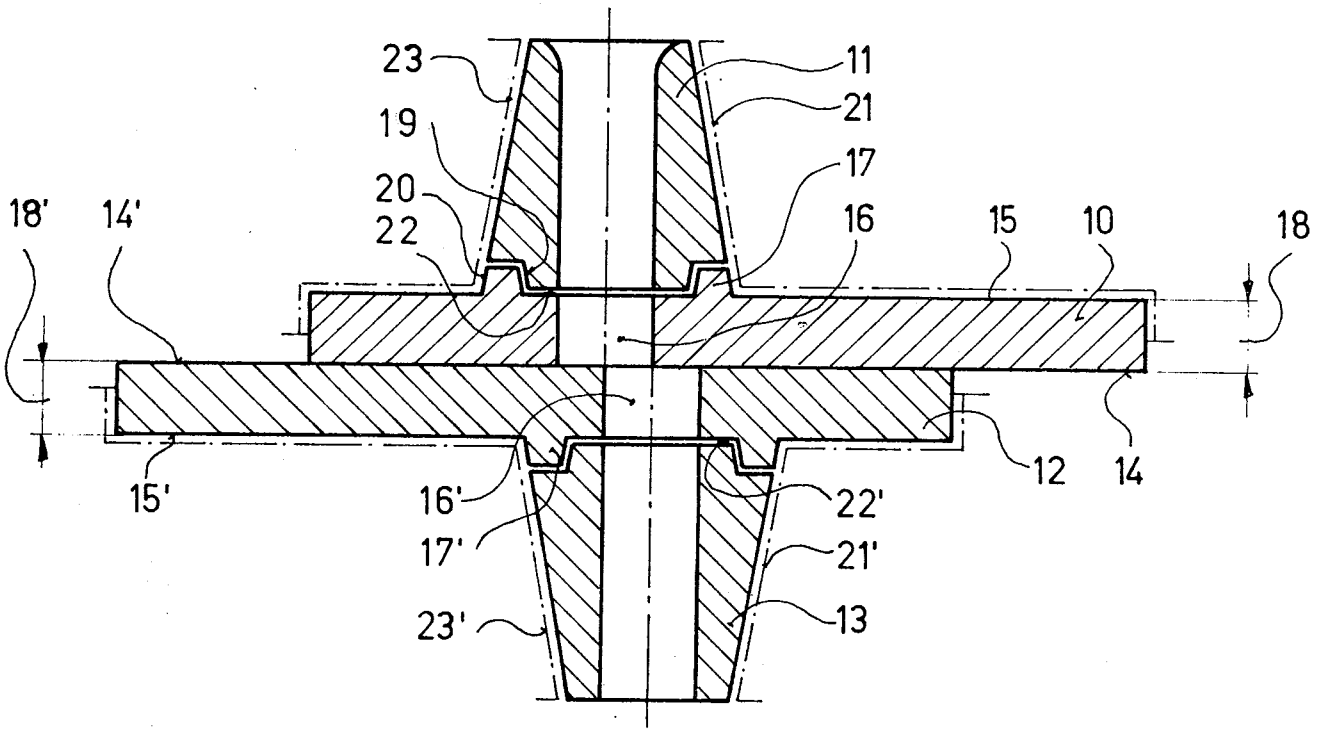
FIG. 1 is a sectional view perpendicular to the flow passage of the elements of the present invention showing a groove and key connection of a two plate closure; and, FIG. 2 is a view similar to that of FIG. 1 but showing a groove and key connection of a three plate sliding valve.

Referring to the drawing, wherein like numerals designate corresponding parts, in FIG. 1 there is shown a fixed bottom plate 10, a perforated stone casing 11 which is situated in the bottom of a vessel partially shown in dotted lines at 11', a longitudinally movable valve plate 12 and an outlet casing 13. The apparatus for moving plate 12 is conventional and is thus not shown. Both plates 10 and 12 have a bead 17, 17' disposed concentrically in relation to the apertures 16 and 16' formed therein, respectively, with the beads 17 and 17' being formed on the sides 15 and 15', respectively, which face away from the abutting sealing surfaces 14 and 14'. The cross sections of the beads 17 and 17' which are in the form of projections extending away from the uniform thickness indicated 18 and 18', are in the form of identical trapezoidal cross sections each with two flanks, the inner one 19 and the outer one 20. The flanks are inclined at an angle of about 10° to 15° in the form of concentric, annular surfaces. The inner flank 19 has its base disposed at a diameter which is larger than the diameter of the apertures 16 and 16'. Both the bottom plate 10 and the valve plate 12 thus form a groove and key connection in the area of the flow passages 16 and 16' either in relation to the stone casing 11 or the outlet casing 13, respectively. In particular, the flank 19 of the beads 17 and 17' define the groove forming portion. The edges of the adjacent parts of the vessel and support structure are indicated in dotted lines at 23, 23' and 21 and 21' which are not illustrated in more detail as these are standard elements which together with the casing surface of the stone casing 11 and the adjacent surfaces of the bottom plate 10 and the jacket surface of the outlet casing 13 respectively, form a joint. Also, the outside diameter of the bead defined by the flank 20 functions as a key forming portion of the connection relative to the parts or surfaces lying directly adjacent to it.

As a matter of practice, the groove and key connection are sealed by means of mortar placed in the gap that exists between them. The butt joints 22 and 22', in the past, have been particularly susceptible to the danger of being washed out, particularly, whenever the joints lie near the sealing surfaces 14 and 14' where, as previously noted, the greatest turbulences occur. The possibility of having the mortar washed out between the butt joints 20 and 22 is minimized by having a flush surface contact or gapless joint provided between these parts of the plates and the casings.

According to the present invention, by way of example, the beads 17 and 17' of the bottom plate 10 and the valve plate 12, respectively, are of the same shape and of the same dimensions so that the plates and the beads can be used with a complimentarily shaped casing either to form a groove or a key forming portion as will be described more fully in connection with FIG. 2. Of course, other portions of the plates 10 and 12 may be of different dimensions and shape depending on considerations which need not be taken into account here. Clearly, however, the advantages of the present invention reside in the fact that the shape and dimensions of the molds of the plate required for the formation of the groove and key connection is independent of the thickness of the plate in the vicinity of the flow apertures. As a result, the positioning of the butt joints 22 and 22' and the problem of manufacturing the plates with the proper thickness in the vicinity of the flow aperture 16 and 16' can be effected in th conventionally simple manner. Also, it should be noted that the beads 17 and 17' are located at a distance from the zone of highest temperature and of the greatest temperature gradient which is the location where changes in the thickness of the plate usually occur therefore, the danger of cracks or fissures occurring which lead to failure of the sealing functions of these elements is greatly minimized if not entirely eliminated.

Figure 2:
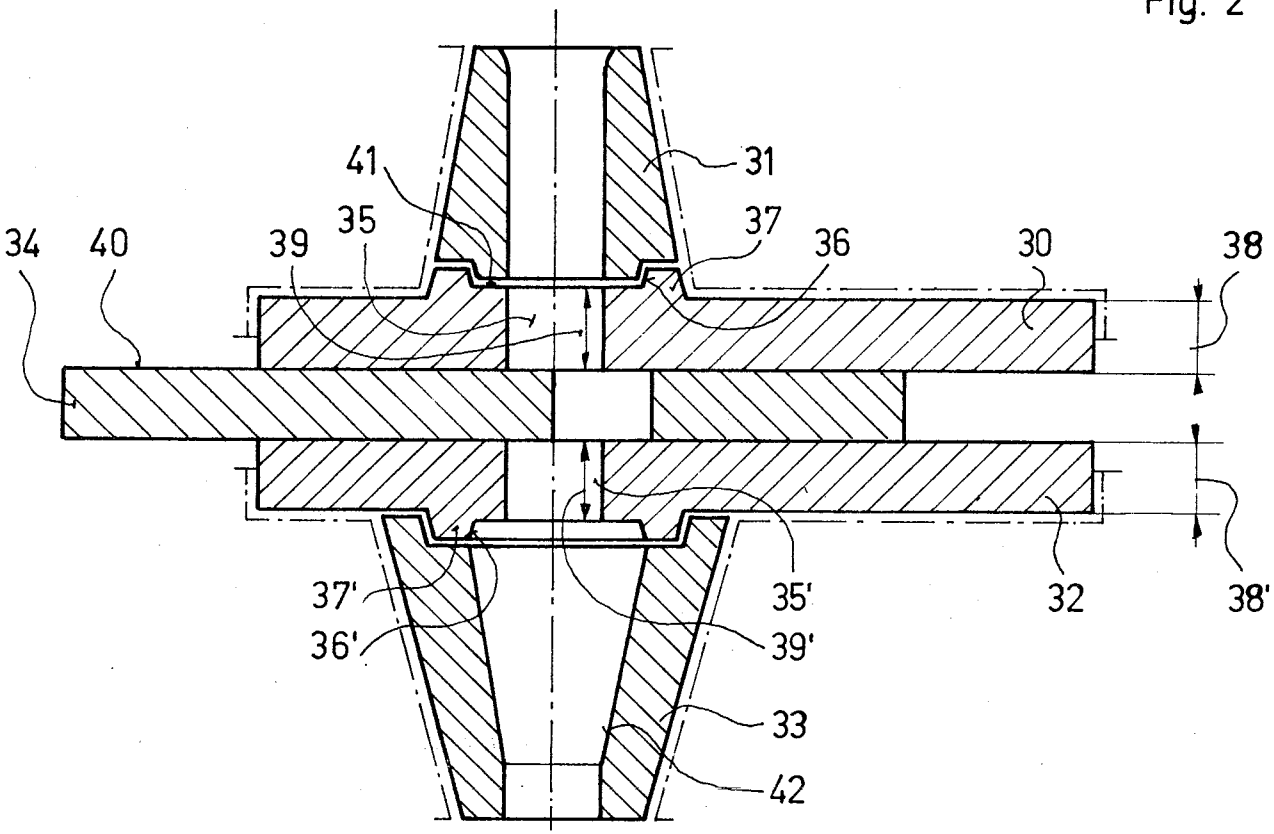

In FIG. 2, another embodiment of the present invention is illustrated which is substantially similar to that of FIG. 1 so that only the essential differences will be described below.

FIG. 2 illustrates a three plate sliding closure which is used, for example, on intermediate crucibles or containers in continuous casting installations. Such arrangements use, in general, a base plate 30, a perforated stone casing 31, an outlet plate 32, an outlet casing 33 as well as the usual valve plate 34 which is disposed to be longitudinally movable between the base plate 30 and the outlet plate 32.

In the field of liquid metal handling, three plate sliding closures have the advantage that the emerging jet or stream of liquid metal does not move about relative to the axis of the flow passages and thus spattering is minimized when the valve plate 34 is moved between its open and closed position. According to the present invention, the base plate 30 and the outlet plate 32 have basically the same shape and dimensions. The thickness 39 and 39' of these plates in the area of flow apertures 35 and 35' and the inside flanks 36 and 36' of the beads 37 and 37' respectively, are larger than the basic thickness indicated at 38 and 38' of the plates 30 and 32. With this arrangement, the location of the butt joint 41 will be spaced at a greater distance from the sealing surface 40 without the width of the thick portion 39, 39' reaching a dimension which would be critical as a result of the above mentioned consequences of heat expansion. The dimensions of the thicknesses 39 and 39' and of the base thicknesses 38 and 38' can, of course, be adapted to the requirements of specific situations so that only a minimum of material expenditure will be needed compared to the conventional thicknesses of such plates thus resulting in a saving of material costs.

The embodiment illustrated in FIG. 2 demonstrates clearly the advantage stemming from the fact that the beads 37 and 37' can be used both as a groove as well as a key forming position. Specifically, relative to the perforated stone casing 31, the bead or key portion 37, on its interior, defines a groove for the complimentarily formed part of the casing 31 whereas the bead 37' functions as a key relative to the complimentarily shaped portion of the outlet casing 33. Thus, according to the accepted practice in which the key cooperating with the groove should be disposed in the direction of flow of the liquid metal, this feature is advantageously retained together with the additional advantage that the two plates 30 and 32 are interchangeable as they can be shaped identically.

The use of the bead 37' as a key functioning portion of the connection with the outlet casing 33 is of particular advantage whenever the outlet casing serves as an immersion outlet, that is to say, whenever the casing has a pipe shaped extension which extends below the surface of the bath level as in a continuous casting process. Such immersion outlets must be capable of being quickly installed and disassembled and, as is conventional, they are attached without mortar on the outlet plate 32 or on its housing indicated in broken lines about the plate 32. With this arrangement, the funnel portion 42 could be constructed with a key forming portion without difficulty which would prevent leakages due to the absence of mortar in the vicinity of the connection.

While the foregoing has been a description of the preferred embodiments, it will be understood that variations of the invention will be apparent to those skilled in the art without departing from the scope of the invention as defined in the appended claims.

What is claimed is:

1. In a device for opening and closing the outlet bore of a vessel of the type used for containing molten metallic material where the device includes:

a protective casing having a through bore, a first plate member having an aperture therethrough aligned with said through bore, valve means including a second plate member having an aperture therethrough, said valve means being mounted for sliding movement relative to said first plate member for controlling flow of said molten material from said bore and first plate aperture through said second plate aperture, an outlet casing having a through bore aligned with said aperture of said second plate member, said casings each having butt joint portions disposed adjacent said respective plate members and surrounding said bores, the improvement comprising:

each of said plate members having sealing surfaces and surfaces opposite said sealing surfaces, said opposite surfaces having means defining a groove and key connection for said casings, said means on each of said opposite surfaces including a bead projecting from said respective opposite surfaces, each bead having inner and outer flank surfaces with said bead surrounding said respective apertures in said plates, said inner and outer flank surfaces being inclined toward one another, and said inner flank surfaces of each bead having a base disposed on a diameter which is substantially greater than the diameter of said respective apertures to form about each said aperture an annulus having a substantial radial dimension, the thickness of each said annulus being less than the combined thickness of the respective plate and its bead, said butt joint portion of said outlet casing forming with its said through bore a recess having a cross-section and sloping surface complementary to the outer end and outer flank surface of said second plate member bead whereby said butt joint portion of the outlet casing is disposed adjacent said second plate member exteriorly of its bead, and the through bore of said outlet casing narrowing in the direction of flow and having its upstream end corresponding in cross-section substantially to the cross-section of the rim of the recess formed in said second plate member by the inner flank surface of its said bead.

2. A device as in claim 1 wherein said valve means includes a third plate member having an aperture therethrough and being disposed between said first and second plate members, said third plate member having opposite sides which are sealing surfaces that respectively engage the said sealing surfaces of said first and second plate members.

3. A device as in claim 1 wherein the thickness of the plate members between a said aperture and a said bead is greater than the thickness of the plate members between the said bead and an edge of said plate members.

4. A device as in claim 1 wherein said first and second plate members are substantially identically constructed for interchangeability, the butt joint portion of the outlet casing being usable with said first plate member and its bead and the butt joint portion of said protective casing being usable with said second plate member and its bead.

5. A device as in claim 1 wherein:

said means includes a third plate member having an aperture therethrough and being disposed between said first and second plate members, said third plate member having opposite sides which are sealing surfaces that respectively engage the said sealing surface of said first and second plate members, the thickness of the plate members between a said aperture and a said bead is greater than the thickness of the plate members between the said bead and an edge of said plate members, and said first and second plate members are substantially identically constructed for interchangeability, the butt joint portion of the outlet casing being usable with said first plate member and its bead and the butt joint portion of said protective casing being usable with said second plate member and its bead.

* * * * *